United States Patent [19]

Perry

[11] Patent Number: 4,746,243

[45] Date of Patent: May 24, 1988

[54] APPARATUS AND METHOD FOR RAPID REPAIR OF DAMAGED AIRFIELD RUNWAYS

[75] Inventor: Gary D. Perry, Lubbock, Tex.

[73] Assignee: Eagle-Picher Industries, Inc., Cincinnati, Ohio

[21] Appl. No.: 867,934

[22] Filed: May 29, 1986

[51] Int. Cl.[4] ..... E01C 5/00; E01C 11/02

[52] U.S. Cl. ..... 404/35; 404/40; 404/72

[58] Field of Search ..... 404/35, 36, 40, 47, 404/54, 64, 69, 49, 72; 52/174, 179, 509; 16/4, 7, 8, 16

[56] References Cited

U.S. PATENT DOCUMENTS

| | | | |
|---|---|---|---|
| 1,040,731 | 10/1912 | Moore | 404/54 |
| 1,145,754 | 7/1915 | Dobert | 404/47 X |
| 1,312,056 | 8/1919 | Shaw | 404/69 X |
| 1,693,903 | 12/1928 | Johnston | 404/72 |
| 2,016,968 | 10/1935 | Marble | 404/47 X |
| 2,286,019 | 6/1942 | Smith | 404/47 |
| 2,996,751 | 8/1961 | Robey et al. | 16/16 X |
| 3,202,067 | 8/1965 | Michard et al. | 404/43 X |
| 3,606,826 | 9/1971 | Bowman | 404/49 |
| 4,404,244 | 9/1983 | Springston | 428/109 |
| 4,468,910 | 9/1984 | Morrison | 404/36 X |

OTHER PUBLICATIONS

"Subcontract Statement of Work to Subtask 1.08, Prototype Mat Anchoring System" U.S. Air Force Engineering and Services Center (AFESC), Tyndall AFB, Fla.

*Primary Examiner*—Stephen J. Novosad
*Assistant Examiner*—Matthew Smith
*Attorney, Agent, or Firm*—Wood, Herron & Evans

[57] ABSTRACT

A bomb crater repair mat is secured to intact pavement surrounding a crater with a novel anchor which secures the mat without piercing it and provides a tapered threshold which reduces jarring of aircraft and prevents the mat from being snagged by aircraft tail hooks or uplifted by jet blast. A slot is cut in the runway adjacent and parallel to the leading and trailing edges of the mat. An extruded member having a T-shaped cross-section is pressed into the slot to secure the mat. The member is retained within the slot by strips projecting from its vertically depending projection and optionally, by also injecting a hardenable filler into the slot.

18 Claims, 2 Drawing Sheets

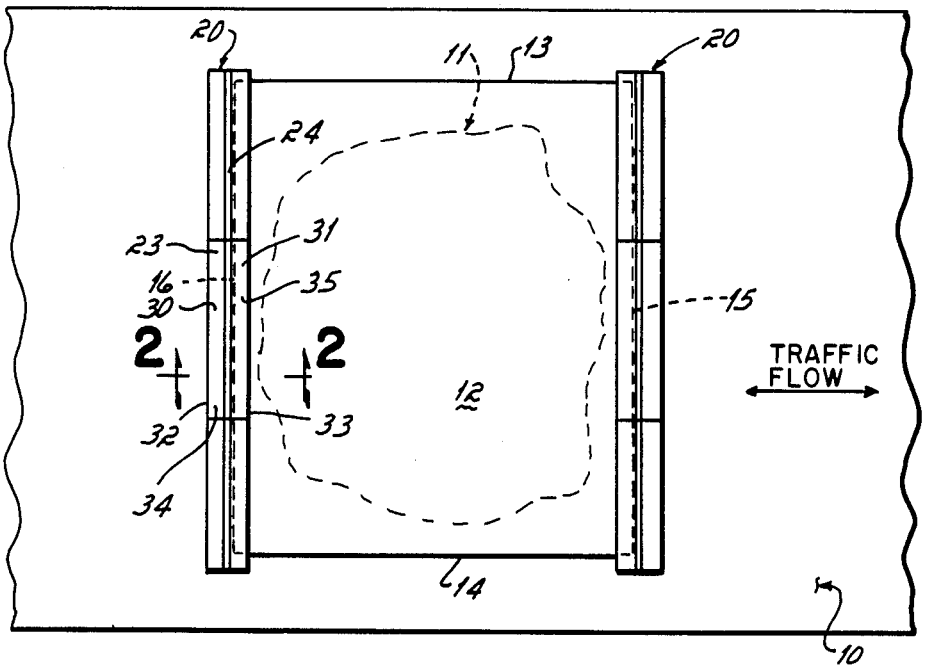
FIG. 1
FIG. 2
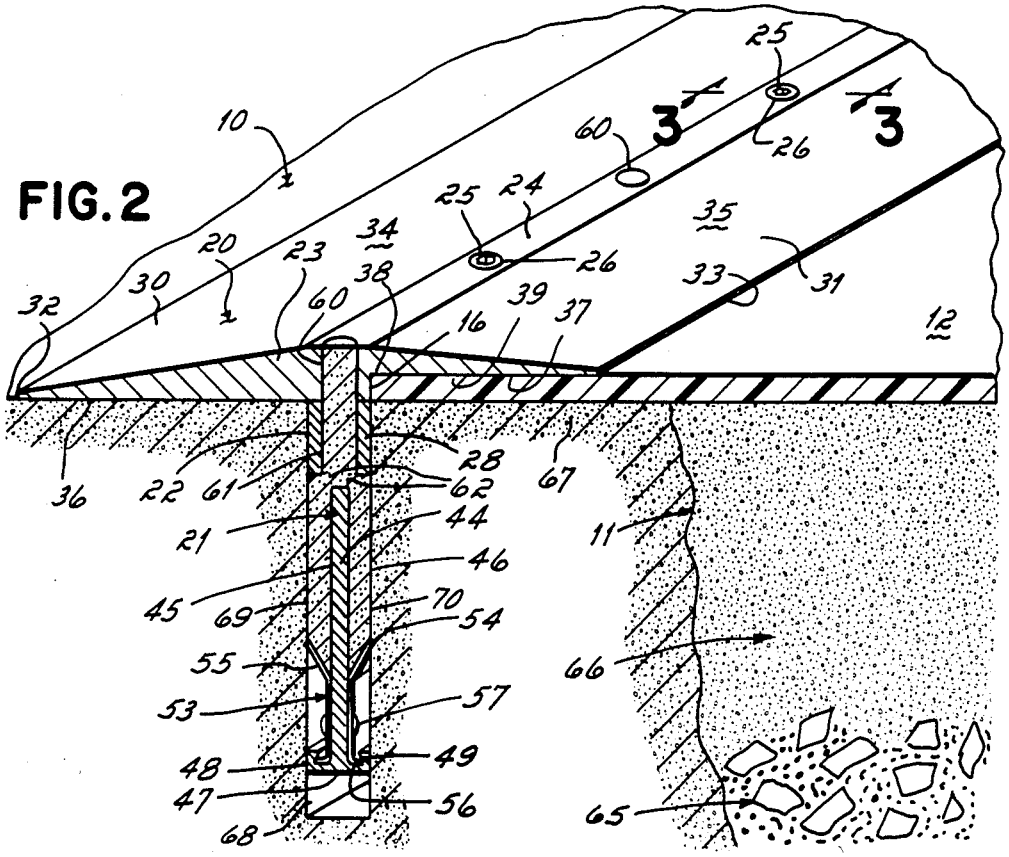

APPARATUS AND METHOD FOR RAPID REPAIR OF DAMAGED AIRFIELD RUNWAYS

FIELD OF THE INVENTION

The present invention relates to the repair of damaged surfaces. More particularly, the invention relates to an apparatus and method for repairing a trafficable surface such as an airfield runway or road which has been cratered by a bomb attack or otherwise breached.

BACKGROUND OF THE DISCLOSURE

Bomb attacks, earthquakes or other disasters often breach the surfaces of airfield runways, roads, and the like with sizeable craters. To avoid or minimize the interruption of essential operations, emergency repair of such breaches may be required. A suitable emergency repair system is one which can be rapidly implemented yet, is sound enough to await more permanent repair measures.

Usually, such emergency repairs are effected by covering the damaged area with some type of mat. For example, the system described in U.S. Pat. No. 4,404,244 to Springston utilizes a membrane of fiberglass-reinforced polyester as a trafficable cover over a backfilled crater. The membrane includes anchor holes about its perimeter which receive torque-set rock bolts to secure the membrane to the undisturbed pavement surrounding the crater. Other repair methods involve bridging damaged areas with rigid decking panels which are secured in a similar fashion.

Regardless of the type of mat employed, prior emergency repair systems suffer from a number of disadvantages with regard to the manner in which they are secured. For instance, previous systems require that the mat be pierced with anchor holes which weaken the mat and which must be aligned with the holes drilled into the pavement to receive the rock bolts. Also, because the mat is secured only at a plurality of discrete points along its periphery by the rock bolts, the areas of the mat between bolts are subject to uplifting by jet blast and snagging by aircraft tail hooks. A further disadvantage of previous systems is that the edges of the mat and rock bolts present themselves as sudden projections which can be snagged by tail hooks and which jar vehicles traversing them.

It is an objective of the invention to provide an apparatus and method for rapid repair of damaged surfaces which provide for securing a repair mat without piercing it and which do not require alignment of anchor bolt holes with holes in the mat for installation. It is a further objective of the invention to provide such an apparatus and method which allow for securing a repair mat continuously along its edge to prevent uplifting by jet blast while avoiding projections which are subject to snagging and which can jar and thereby damage vehicles traversing the mat.

SUMMARY OF THE INVENTION

According to the present invention, a repair mat is secured along its leading and trailing edges with a clamp which holds the mat without piercing it and which provides a tapered threshold which reduces jarring of aircraft and prevents the mat from being snagged by aircraft tail hooks or uplifted by jet blast.

To secure the mat, an elongated slot is first sawed in the undisturbed pavement along the leading and trailing edges of the mat.

The clamp is an elongated member of substantially T-shaped cross-section. The vertical web of the T is received in a slot and held in place by one or more strips projecting from the vertical web or by a hardenable filler injected into the slot or both. The edge of the mat is captured beneath one of the generally horizontally extending webs of the T while the opposing horizontal web tapers downwardly and outwardly, thinning toward its outer edge to provide a tapered threshold.

Since there is no need to align holes in the mat with holes bored in the pavement, installation is fast and simple. Clamping the mat along the length of its leading and trailing edges holds the mat firmly in place and avoids its being snagged or uplifted by jet exhaust. The tapered upper surfaces of the clamp reduce the jarring of aircraft or other vehicles traversing the clamps. The top portion of the clamp is unbolted and removed to facilitate permanent repair of the crater after the clamp has served its purpose.

BRIEF DESCRIPTION OF THE DRAWINGS

FIG. 1 is a plan view illustrating the repair of a cratered surface using the present invention.

FIG. 2 is a perspective view partly in section taken along line 2—2 of FIG. 1, illustrating the repair of a cratered surface using the present invention.

DESCRIPTION OF THE PREFERRED EMBODIMENT

Figure 3:
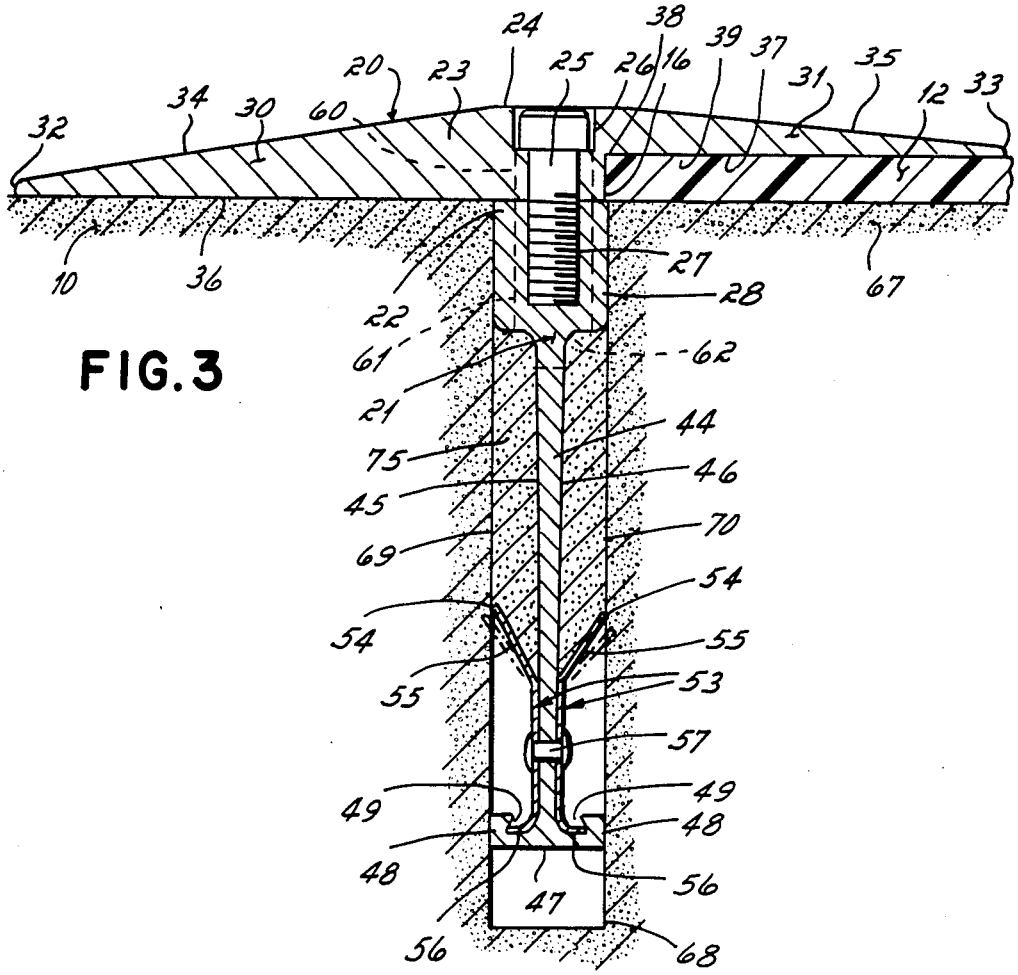
FIG. 3 is a side sectional view of the apparatus of the invention taken along line 3—3 of FIG. 2.

FIG. 1 shows the invention installed in a typical environment. An airfield runway 10 has a crater 11 which has been backfilled and covered with a repair mat 12 having opposed sides 13 and 14 as well as a leading edge 15 and an opposed trailing edge 16. Leading and trailing edges 15 and 16 are each held in place along their length by one or more elongated clamps 20.

As is best seen in FIGS. 2 and 3, the apparatus of the invention comprises an elongated clamp 20 of substantially "T"-shaped cross-section. Clamp 20 can be described as having a vertically depending anchor 21 fastened at its upper end 22 to a horizontally disposed threshold 23 along a thickened central spine 24. Threshold 23 is removably joined to anchor 21 by a plurality of cap screws 25, each of which passes through a smooth, counterbored hole 26 traversing the central spine 24 of threshold 23 and is received within a mating, threaded hole 27 located in a thickened section 28 of the upper end 22 of anchor 21.

Threshold member 23 has a ramp flange 30 and an opposed clamp flange 31 which extend generally horizontally outwardly from central spine 24 toward their respective outer edges 32 and 33 each of which edges 32,33 are preferably rounded and low in height. Ramp flange 30 has an upper surface 34 which slopes downwardly and outwardly from central spine 24 so that ramp flange 30 tapers thinningly toward its outer edge 32. In a similar manner, clamp flange 31 has an upper surface 35 which slopes downwardly and outwardly in the opposite horizontal direction from central spine 24 so that clamp flange 31 also tapers thinningly toward its outer edge 33. Tapered surfaces 34,35 reduce jarring of aircraft or other vehicles traversing clamp 20 by providing gradual ramped surfaces instead of a sudden projection. The underside 36 of ramp flange 30 is substantially flat while the underside 37 of clamp flange 31 includes a shoulder 38 creating a recess 39.

In addition to the thickened section 28 located near its upper end 22, anchor 21 further includes a thinner, downwardly tapered web 44 which adjoins thickened section 28 and which has opposed sides 45 and 46. Immediately below web 44, the lower end 47 of anchor 21 terminates in a horizontally disposed stabilizing flange 48 which carries a pair of upwardly projecting, undercut outer ridges 49.

A resilient gripper strip 53 is fastened to each side 45,46 of web 44 near the lower end 47 of anchor 21. Each gripper strip 53 has an upper edge 54 carried by an outwardly and upwardly projecting fin 55 having a turned-out lower edge 56. Each gripper strip 53 is secured to anchor 21 by a plurality of rivets 57 as well as by capturing its turned-out lower edge 56 beneath each undercut ridge 49 of stabilizing flange 48.

A plurality of injection holes 60 traverse the central spine 24 of threshold 23 and align with a plurality of corresponding holes 61 which pass through the thickened section 28 of anchor 21. Each hole 61 is slightly larger in diameter than the thickness of the web 44 of anchor 21 and is aligned therewith so that each hole 61 terminates in a pair of injection ports 62 discharging on opposite sides 45,46 of anchor 21.

Anchor 21 and threshold 23 are preferably fabricated as extrusions. Extrusions offer the advantages of relatively low tooling cost, readily variable lengths and good surface finish without additional finishing operations. Clamp 20 may be of any convenient length, 8 to 12 feet being preferred for ease of handling, storage and transportation. While anchor 21 and threshold 23 may be made of any suitable material, they are preferably made of aluminum alloy for example, 6061-T6, which combines the properties of relatively low cost with high strength, light weight and good corrosion resistance. Gripper strip 53 may be formed from a compatible material for example 0.040 inch thick 2024-T3 aluminum alloy sheet.

Installation of clamp 20 is illustrated in FIGS. 1 and 3. A crater 11 in a runway 10 may be repaired utilizing clamp 20 by back-filling the crater 11 first with debris 65 then with compacted crushed stone 66 and covering the crater 11 with a rectangular mat 12 having opposed sides 13,14 a leading edge 15 and an opposed trailing edge 16. As used herein and in the claims, the terms "leading edge" and "trailing edge" refer to those edges 15,16 of the mat 12 which lie perpendicular to the direction of flow of traffic over mat 12 regardless of which edge 15,16 is first traversed. Mat 12 may take the form of a fiberglass membrane as described in U.S. Pat. No. 4,404,244 which is incorporated herein by reference in its entirety. Alternatively, mat 12 may take the form of rigid decking capable of bridging crater 11 and supporting traffic loads without backfilling. Regardless of the type of mat 12 employed, it should be large enough that its leading and trailing edges 15,16 overlap an area of substantially undisturbed pavement 67 which is at least as wide as the recess 39 of clamp flange 31 and preferably, somewhat wider.

Once the mat 12 is in place, a slot 68 is cut into the substantially undisturbed pavement 67 along the length of, adjacent and parallel to the leading and trailing edges 15,16 of the mat 12. Slot 68 may be cut with a standard masonry saw and should be slightly deeper than the length of anchor 21. Clamp 20 is restrained from excessive rocking movement by sizing slot 68 to be only slightly wider than the width of stabilizing flange 48 extending from the lower end 47 of anchor 21. At the same time, slot 68 is sized to be narrower than the distance between the upper edges 54 of the projecting fins 55 of resilient gripper strip 53 when anchor 21 is in its normal, uninstalled condition.

The lower end 47 of anchor 21 is then inserted into slot 68 with anchor 21 being oriented such that ramp flange 30 extends away from mat 12 and clamp flange 31 overhangs a leading edge 15 or trailing edge 16 of mat 12. Anchor 21 is then forced downwardly into slot 68 so that anchor 21 is received completely within slot 68. At this time, the edge 15,16 of mat 12 is captured securely beneath the clamp flange 31 of threshold 23 and is received within recess 39. At the same time, the underside 36 of the ramp flange 30 rests upon the surface of the runway 10.

As the fins 55 of resilient gripper strip 53 are forced down into slot 68, they are deflected upwardly by the side walls 69,70 of slot 68. Due to the resilient nature of gripper strip 53, once anchor 21 is installed within slot 68, fins 55 continue to exert a spring force against side walls 69 and 70 of slot 68 which tend to hold clamp 20 securely in place. Forces tending to pull anchor 21 from slot 68 will be countered by this spring force which will cause the upper edges 54 of fins 55 to grip or dig into the side walls 69 and 70 of slot 68. For light-duty applications where the side walls 69,70 of slot 68 are sufficiently sound, the gripper strips 53 alone may be sufficient to secure the mat 12.

In other applications, it may be desirable to augment the securement provided by gripper strips 53 by filling slot 68 at least partially, with a hardenable filler 75 such as epoxy or concrete. This is preferably accomplished after clamp 20 is already in place within slot 68 by injecting the hardenable filler 75 under pressure through one or more of the injection holes 60 in threshold 23, each of which communicates with a pair of injection ports 62 to deposit hardenable filler 75 within slot 68 on both sides 45,46 of anchor 21. While concrete is suitable for application in temperate climates, epoxy is preferred in areas subject to freezing. In addition to gripping the side walls 69 and 70 of slot 68, it can be seen that the projecting fins 55 extending from gripper strip 53 also serve to hold anchor 21 in the hardenable filler 75 when such filler is employed. In the event a single clamp 20 is not as long as the edge 15,16 of the mat 12, a plurality of clamps 20 may be installed in end to end fashion to secure substantially the entirety of the leading and trailing edges 15,16 of the mat 12 as shown in FIG. 1.

When crater 11 is to be repaired in a more permanent fashion, mat 12 may be removed by the simple expedient of removing threshold 23 by removing cap screws 25. It is not necessary to remove anchor 21 from slot 68. This is particularly true if anchor 21 is embedded in hardenable filler 75 since the surface of the filler 75 and the upper end 22 of anchor 21 are substantially coplanar with the surface of the runway 10. If desired, the threaded holes 27 in anchor 21 may be filled with epoxy or other suitable material as may any other voids or surface imperfections which might be of concern.

The present invention may, of course, be carried out in other specific ways than those set forth above without departing from the scope of the invention. Accordingly, the embodiments described are to be considered as illustrative only and not limitations of the claims appended hereto.

I claim:

1. A claimp for securing a repair mat to a surface having a slot therein, said clamp comprising:

an elongated member of substantially T-shaped cross-section, said member having a substantially continuous vertically depending elongated anchor adapted to be secured directly within said slot in said surface, said anchor being joined to a generally horizontally extending threshold member, said threshold member having a ramp flange and an opposed, clamp flange, said ramp flange having an underside adapted to rest atop said surface, said clamp flange having recess forming an underside surface which is adapted to capture at least a protion of an edge of said mat beneath said claim flange when said anchor is inserted within said slot.

2. The clamp of claim 1 wherein: said anchor includes at least one fin projecting from said anchor to grip said slot to at least partially secure said anchor within said slot when said anchor is inserted in said slot.

3. The clamp of claim 1 wherein said ramp flange is tapered downwardly and outwardly, thinning toward the outer edge of said ramp flange.

4. The clamp of claim 1 wherein said clamp flange is tapered downwardly and outwardly, thinning toward the outer edge of said clamp flange.

5. The clamp of claim 1 further comprising at least one projection extending outwardly from said anchor to stabilize said anchor within said slot.

6. The clamp of claim 1 wherein: said threshold is joined removably to said anchor whereby said threshold may be removed to permit permanent repair of said surface without removing said anchor from said slot.

7. The clamp of claim 1 wherein said threshold includes an injection hole in communication with said slot when said clamp is installed within said slot whereby said slot may be filled at least partially with a hardenable filler to at least partially secure said anchor within said slot.

8. A clamp for securing a repair mat to a surface having a slot therein, said clamp comprising:

(a) a generally horizontally extending threshold, said threshold having a ramp flange and an opposed clamp flange, said ramp flange having an underside adapted to rest atop said surface, said clamp flange being adapted to capture at least a portion of an edge of said mat beneath at least a portion of said clamp flange when said anchor is secured within said slot;

(b) a vertically depending elongated anchor joined at its upper end to said threshold;

(c) a horizontal flange extending from the lower end of said anchor to stabilize said clamp within said slot; and (d) at least one gripper strip on said anchor, each gripper strip having an upwardly and outwardly projecting fin to engage said slot to at least partially secure said anchor directly within said slot when said anchor is inserted within said slot.

9. The clamp of claim 8 wherein said threshold includes an injectin hole in communication with said slot when said clamp is installed within said slot whereby said slot may be filled at least partially with a hardenable filler to at least partially secure said anchor within said slot.

10. The clamp of claim 8 wherein said threshold is removably joined to said anchor so that said threshold member may be removed to permit permanent repair of said surface without removing said anchor from said slot.

11. A covering for a breach in a trafficable surface, comprising:

(a) a mat for overlying the breach, said mat having opposed leading and trailing edges;

(b) an elongated anchor adapted to be secured within a slot in said surface, said slot lying substantially adjacent and parallel to at least one of said leading and trailing edges;

(c) a generally horizontally extending threshold joined to the upper end of said anchor, said threshold having a ramp flange and an opposed clamp flange, said ramp flange having an underside adapted to rest atop said surface, said clamp flange having a recess forming an underside surface which captures at least a portion of at least one of said leading and trailing edges beneath said threshold when said anchor is secured within said slot.

12. The method of covering a breach in a trafficable surface with a secured mat, said method comprising the steps of:

(a) covering said breach with a mat having opposed upper and lower surfaces and at least one edge;

(b) cutting a slot into the surface along an edge of the mat;

(c) securing within said slot the vertically depending anchor of an elongated member of substanitally T-shaped cross-section, said member having in addition to said anchor, a pair of opposed, generally horizontally extending flanges, and (d) capturing at least a portion of the edge and upper surface of the mat beneath one of said generally horizontally extending flanges to secure the mat to the surface.

13. The method of claim 12 wherein: said edge of the mat is at least one of the leading edge and the trailing edge of the mat.

14. The method of claim 12 wherein: said anchor is secured within said slot at least partially by at least one fin projecting from said anchor.

15. The method of claim 12 wherein: said anchor is secured within said slot at least partially by a hardenable filler located within at least a portion of said slot.

16. The method of claim 15 wherein: said hardenable filler is selected from the group consisting of epoxy and concrete.

17. The method of claim 12 wherein: said anchor is secured within said slot by at least one fin projecting from said anchor and by a hardenable filler located within at least a portion of said slot.

18. The method of repairing a cratered runway, comprising the steps of:

(a) covering the crater with a mat;

(b) cutting a slot into the runway along an edge of said mat;

(c) securing within said slot the vertically depending elongated anchor of an elongated member of substantially T-shaped cross-section, said elongated member having in addition to said anchor a ramp flange and an opposed clamp flange, said ramp flange having an underside resting atop said runway, said clamp flange having a recess forming an underside surface which captures at least a portion of an edge of said mat beneath said clamp flange when said anchor is secured within said slot.

* * * * *